US010959590B2

(12) United States Patent
Moser et al.

(10) Patent No.: US 10,959,590 B2
(45) Date of Patent: Mar. 30, 2021

(54) SURFACE CLEANING MACHINE

(71) Applicant: Alfred Kärcher GmbH & Co. KG, Winnenden (DE)

(72) Inventors: Fabian Moser, Schorndorf (DE); Christoph Rufenach, Korntal-Muenchingen (DE); Rainer Kurmann, Aspach (DE); Andreas Mueller, Oppenweiler (DE); Manuel Schulze, Kornwestheim (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 367 days.

(21) Appl. No.: 15/949,863

(22) Filed: Apr. 10, 2018

(65) Prior Publication Data

US 2018/0228331 A1 Aug. 16, 2018

Related U.S. Application Data

(63) Continuation of application No. PCT/EP2015/073529, filed on Oct. 12, 2015.

(51) Int. Cl.
*A47L 11/20* (2006.01)
*A47L 7/00* (2006.01)
(Continued)

(52) U.S. Cl.
CPC ..... *A47L 11/201* (2013.01); *A47L 7/0004* (2013.01); *A47L 11/145* (2013.01); *A47L 11/202* (2013.01);
(Continued)

(58) Field of Classification Search
CPC .... A47L 11/145; A47L 11/201; A47L 11/202; A47L 11/4005; A47L 11/4013; A47L 7/0004
See application file for complete search history.

(56) References Cited

U.S. PATENT DOCUMENTS 1,436,420 A 11/1922 Weydell
4,136,420 A 1/1979 Cyphert et al.
(Continued)

FOREIGN PATENT DOCUMENTS

CA 2 411 936 11/2003
CH 607 578 9/1978
(Continued)

*Primary Examiner* — Marc Carlson
(74) *Attorney, Agent, or Firm* — Womble Bond Dickinson (US) LLP

(57) ABSTRACT

A surface cleaning machine is provided, including a device body having a housing, a suction unit device having a fan, said suction unit device being arranged in the housing, a cleaning head which is arranged at the device body outside of the housing and comprises at least one cleaning roller and is operatively connected to the suction unit device for fluid communication therewith, an air-cooled drive motor for rotatingly driving the at least one cleaning roller, and a process air routing device for process air of the suction unit device, wherein the drive motor is arranged outside of the housing of the device body and wherein a cooling air routing device for cooling air of the drive motor comprises at least one fluid path which is arranged at or in the housing and/or wherein the cooling air routing device is coupled to the process air routing device.

40 Claims, 9 Drawing Sheets

(51) Int. Cl.
*A47L 11/40* (2006.01)
*A47L 11/14* (2006.01)
*A47L 11/202* (2006.01)

(52) U.S. Cl.
CPC ..... *A47L 11/4005* (2013.01); *A47L 11/4013* (2013.01)

(56) References Cited

U.S. PATENT DOCUMENTS

| | | | | |
|---|---|---|---|---|
| 4,173,054 | A | 11/1979 | Ando | |
| 4,668,256 | A | 5/1987 | Billiet et al. | |
| 5,086,539 | A | 2/1992 | Rench | |
| 5,350,432 | A | 9/1994 | Lee | |
| 5,657,504 | A | 8/1997 | Khoury | |
| 5,797,163 | A | 8/1998 | Whitaker et al. | |
| 5,920,939 | A * | 7/1999 | Worwag | A46B 13/001 15/41.1 |
| 6,026,529 | A | 2/2000 | Caruso | |
| 6,400,048 | B1 | 6/2002 | Nishimura et al. | |
| 6,475,256 | B2 | 11/2002 | Matsubara et al. | |
| 6,662,402 | B2 | 12/2003 | Giddings et al. | |
| 6,735,812 | B2 | 5/2004 | Heiman et al. | |
| 7,128,770 | B2 | 10/2006 | Oh et al. | |
| 7,150,068 | B1 | 12/2006 | Ragner | |
| 7,272,870 | B2 | 9/2007 | Pierce et al. | |
| 7,341,611 | B2 | 3/2008 | Greene et al. | |
| 7,559,963 | B2 | 7/2009 | Oh et al. | |
| 7,665,174 | B2 | 2/2010 | Basham et al. | |
| 7,921,497 | B2 | 4/2011 | Cook et al. | |
| 7,967,914 | B2 | 6/2011 | Giddings et al. | |
| 7,979,952 | B2 | 7/2011 | Beskow et al. | |
| 8,016,996 | B2 | 9/2011 | Field et al. | |
| 8,025,786 | B2 | 9/2011 | Field et al. | |
| 8,230,549 | B2 | 7/2012 | Lenkiewicz et al. | |
| 9,289,105 | B2 | 3/2016 | Moes | |
| 9,999,332 | B2 | 6/2018 | Braendle et al. | |
| 10,130,230 | B2 * | 11/2018 | Moser | A47L 5/30 |
| 10,349,797 | B2 * | 7/2019 | Moser | A47L 11/4041 |
| 2002/0124334 | A1 * | 9/2002 | Worwag | A47L 9/0416 15/52.1 |
| 2002/0194692 | A1 | 12/2002 | Giddings et al. | |
| 2003/0159232 | A1 | 8/2003 | Hekman et al. | |
| 2005/0160553 | A1 | 7/2005 | Gregory | |
| 2005/0262659 | A1 | 12/2005 | Roschi et al. | |
| 2007/0209144 | A1 | 9/2007 | Fester et al. | |
| 2009/0089967 | A1 | 4/2009 | Yang et al. | |
| 2009/0119871 | A1 * | 5/2009 | Dilger | A47L 9/04 15/415.1 |
| 2010/0132150 | A1 | 6/2010 | Egler et al. | |
| 2010/0236010 | A1 | 9/2010 | Johnson | |
| 2012/0066861 | A1 | 3/2012 | Louis et al. | |
| 2012/0167332 | A1 * | 7/2012 | Hawkins | A47L 9/22 15/323 |
| 2012/0222244 | A1 | 9/2012 | Conrad | |
| 2013/0091663 | A1 | 4/2013 | Mersmann | |
| 2013/0219641 | A1 | 8/2013 | Guijarro | |
| 2014/0000060 | A1 | 1/2014 | Demirtas et al. | |
| 2014/0150984 | A1 | 6/2014 | Nishikawa et al. | |
| 2014/0173847 | A1 | 6/2014 | Nguyen | |
| 2014/0182079 | A1 | 7/2014 | Van Der Kooi et al. | |
| 2015/0082579 | A1 | 3/2015 | Lin | |
| 2016/0270613 | A1 | 9/2016 | Demirtas et al. | |
| 2016/0278597 | A1 | 9/2016 | Braendle et al. | |
| 2017/0215676 | A1 | 8/2017 | Moser et al. | |
| 2017/0215677 | A1 | 8/2017 | Moser et al. | |
| 2017/0215678 | A1 | 8/2017 | Moser et al. | |
| 2017/0215679 | A1 | 8/2017 | Moser et al. | |
| 2017/0215681 | A1 | 8/2017 | Moser et al. | |

FOREIGN PATENT DOCUMENTS

| | | | | |
|---|---|---|---|---|
| CN | 2109165 | | 7/1992 | |
| CN | 2174947 | | 8/1994 | |
| CN | 2266377 | | 11/1997 | |
| CN | 2675734 | | 2/2005 | |
| CN | 1718149 | | 1/2006 | |
| CN | 2845698 | Y | 12/2006 | |
| CN | 201158807 | | 12/2008 | |
| CN | 201384462 | | 1/2010 | |
| CN | 201930938 | | 8/2011 | |
| CN | 202151938 | | 2/2012 | |
| CN | 102493381 | | 6/2012 | |
| CN | 202313126 | | 7/2012 | |
| CN | 203346836 | | 12/2013 | |
| CN | 103690112 | | 4/2014 | |
| DE | 294 642 | | 10/1991 | |
| DE | 41 17 957 | | 12/1992 | |
| DE | 102 42 257 | | 4/2003 | |
| DE | 10 2004 013 262 | | 9/2005 | |
| DE | 10 2007 031 371 | | 1/2009 | |
| DE | 10 2008 013 485 | | 11/2009 | |
| DE | 102015105906 | A1 * | 10/2016 | A47L 9/0411 |
| EP | 0 012 337 | | 6/1980 | |
| EP | 0 186 005 | | 7/1986 | |
| EP | 0 844 843 | | 7/2002 | |
| EP | 1 535 560 | | 1/2005 | |
| EP | 1 465 518 | | 4/2005 | |
| EP | 1 736 089 | | 12/2006 | |
| EP | 1994868 | | 11/2008 | |
| EP | 2 177 128 | | 4/2010 | |
| EP | 2 387 932 | | 11/2011 | |
| EP | 2 641 524 | | 9/2013 | |
| EP | 2 721 988 | | 4/2014 | |
| FR | 2 797 895 | | 3/2001 | |
| GB | 1123052 | | 8/1968 | |
| GB | 2 341 124 | | 3/2000 | |
| GB | 2 411 823 | | 9/2005 | |
| GB | 2 420 967 | | 6/2006 | |
| GB | 2 435 820 | | 9/2007 | |
| JP | 2000342495 | | 12/2000 | |
| JP | 2001037695 | | 2/2001 | |
| JP | 2001-095737 | A | 4/2001 | |
| JP | 2005-211350 | | 8/2005 | |
| JP | 2008-132211 | A | 6/2008 | |
| JP | 2013081829 | | 5/2013 | |
| JP | 2015-058050 | A | 3/2015 | |
| WO | WO 84/04663 | | 12/1984 | |
| WO | WO 90/14787 | | 12/1990 | |
| WO | WO 97/06721 | | 2/1997 | |
| WO | WO 00/78198 | | 12/2000 | |
| WO | WO 01/037716 | | 5/2001 | |
| WO | WO 02/28251 | | 4/2002 | |
| WO | WO 02/069775 | | 9/2002 | |
| WO | WO 2005/089614 | | 9/2005 | |
| WO | WO 2005/096907 | | 10/2005 | |
| WO | WO 2006/102147 | | 9/2006 | |
| WO | WO 2006/110459 | | 10/2006 | |
| WO | WO 2010/041185 | | 4/2010 | |
| WO | WO 2010/140967 | | 12/2010 | |
| WO | WO 2013/027140 | | 2/2013 | |
| WO | WO 2013/027164 | | 2/2013 | |
| WO | WO 2013/106762 | | 7/2013 | |

* cited by examiner

SURFACE CLEANING MACHINE

CROSS-REFERENCE TO RELATED APPLICATIONS

This application is a continuation of international application number PCT/EP2015/073529 filed on Oct. 12, 2015, which is incorporated herein by reference in its entirety and for all purposes.

BACKGROUND OF THE INVENTION

The invention relates to a surface cleaning machine, comprising a device body having a housing, a suction unit device having a fan, said suction unit device being arranged in the housing, a cleaning head which is arranged at the device body outside of the housing and comprises at least one cleaning roller and is operatively connected to the suction unit device for fluid communication therewith, an air-cooled drive motor for rotatingly driving the at least one cleaning roller, and a process air routing device for process air of the suction unit device.

WO 2013/027140 A1 discloses a cleaning device for cleaning a surface, said cleaning device comprising a rotatable brush. Further provided is a rubber wiper element which is spaced apart from the brush and is fixed to an underside of a nozzle housing.

WO 2013/027164 A1 likewise discloses a cleaning device having a rotatable brush and a single rubber wiper element.

EP 2 177 128 A1 discloses a device for distributing fluid on a brush.

DE 41 17 157 A1 discloses a method for cleaning or swabbing a preferably smooth surface, in which method the surface to be cleaned is wiped using a substantially cloth-like wiping element while picking up the dirt with the wiping element, and then the dirty wiping element is wetted and thereafter the dirt is suctioned from the wiping element.

WO 2010/140967 A1 discloses a method for cleaning a soiled surface.

CH 607 578 discloses a brush device which can be connected to a water conduit.

EP 0 186 005 A1 discloses a brush suction mouthpiece which is provided with travel wheels.

FR 2 797 895 discloses a brush.

US 2002/0194692 A1 discloses a method for mechanically removing dirt from a surface.

WO 2013/11789 A1 discloses a cleaning head for a vacuum cleaner.

U.S. Pat. No. 6,400,048 B1 discloses an apparatus having a rotating brush, in which a motor is arranged on a first end of a cylindrical body and a speed reduction mechanism is arranged on a second end of the cylindrical body. An electric blower is arranged outside of the cylindrical body and serves to blow air into the cylindrical body for cooling the motor.

SUMMARY OF THE INVENTION

In accordance with an exemplary embodiment of the invention, a surface cleaning machine is provided which is conferred high resistance to splash water with simple construction.

In accordance with an exemplary embodiment of the invention, the surface cleaning machine comprises a device body having a housing, a suction unit device having a fan, said suction unit device being arranged in the housing, a cleaning head which is arranged at the device body outside of the housing and comprises at least one cleaning roller and is operatively connected to the suction unit device for fluid communication therewith, an air-cooled drive motor for rotatingly driving the at least one cleaning roller, and a process air routing device for process air of the suction unit device, wherein the drive motor is arranged outside the housing of the device body and wherein a cooling air routing device for cooling air of the drive motor comprises at least one fluid path which is arranged at or in the housing and/or wherein the cooling air routing device is coupled to the process air routing device.

The drive motor is air-cooled. By way of a cooling air routing device, which comprises at least one channel by which is formed the at least one fluid path which is arranged at or in the housing, a cooling air inlet or cooling air outlet can be provided at a large distance from the at least one cleaning roller and in particular at and preferably in an upper area of the housing. It is thereby possible for a high degree of protection against splash water to be obtained for the area of the cleaning head. The number of (air) openings at the or in the vicinity of the cleaning head can be kept low.

If the cooling air routing device is coupled to the process air routing device, fluid paths and/or openings can be used jointly for cooling air and process air. The number of inlets and/or outlets can be reduced.

Furthermore, the suction unit device can be used to suction cooling air from the cooling air routing device.

It is particularly advantageous for the process air routing device and the cooling air routing device to comprise at least one common fluid path. It is thereby possible for one outlet and/or one inlet to be used jointly for cooling air and process air. As a result, the surface cleaning machine is conferred high resistance to splash water with simple construction.

It is advantageous for the cooling air routing device to comprise a cooling air inlet and a cooling air outlet and for the process air routing device to comprise a process air inlet and a process air outlet and for the cooling air inlet and the process air inlet to coincide and/or for the cooling air outlet and the process air outlet to coincide. The number of inlets or outlets and hence of the air openings can thereby be kept low. This results in a high degree of protection against splash water for the surface cleaning machine.

For the same reason, it is advantageous for the process air outlet to form the cooling air outlet and/or for the process air inlet to form the cooling air inlet.

In an exemplary embodiment, a cooling air inlet is provided, a process air inlet is provided and a common outlet for cooling air and process air is provided. The cooling air inlet and the process air inlet are separate from one another. It is thereby possible to provide only two inlets and one outlet in total for cooling air and process air.

It is advantageous for the cooling air inlet to be arranged at the cleaning head or at a transition region from the cleaning head to the housing of the device body. This results in a short routing path for intake cooling air to the drive motor.

In particular, the process air inlet is formed by one or more suction mouths at the cleaning head.

It is advantageous for the cooling air inlet to be arranged at a distance from the process air inlet and, in particular when the surface cleaning machine is operated in a cleaning mode, to be positioned above the process air inlet with respect to the direction of gravity. As a result, this provides optimized capability of coupling in, and in particular of suctioning in, intake cooling air.

In an exemplary embodiment, the process air outlet is arranged at the device body and in particular is arranged at the housing of the device body and in particular is arranged at a distance from the cleaning head and in particular is arranged at a distance from the drive motor. This allows process air to be discharged to the environment at a location relatively far away from the at least one cleaning roller. By appropriate coupling of the cooling air routing device, exhaust cooling air can also be discharged to the environment there.

In an exemplary embodiment, the drive motor is arranged in a motor housing. The motor housing can be used for routing the flow of cooling air.

In particular, the cooling air routing device comprises at least one fluid path through the motor housing and preferably through the drive motor. Optimized air cooling of the drive motor can thereby be achieved.

It is advantageous for the motor housing to be arranged in a sleeve. Via the sleeve, it is possible to configure a joint, for example in the form of an internal sleeve, via which the cleaning head is pivotable relative to the device body. Furthermore, the sleeve can be used for flow routing. In particular, a wall (and also a wall of a motor housing) can be used as a wall of one or more flow channels. This results in simple construction with ease of manufacturability of the surface cleaning machine and high protection against splash water.

In particular, the cooling air routing device comprises at least one fluid path which is located along the sleeve and/or between the sleeve and the, or a, motor housing. This provides a simple way of implementing intake air flow channels for intake cooling air to the drive motor.

In particular, the cooling air routing device comprises a first fluid path which extends along the sleeve and is located at an exterior side of the sleeve, and comprises a second fluid path which extends along the sleeve at an interior side of the sleeve facing towards the motor housing. This results in optimized capability of supplying intake cooling air to the drive motor with simple construction.

In particular, the motor housing extends along an axial direction (which is in particular coincident with a drive axis of the drive motor) between a first end and a second end, and a cooling air inlet of the cooling air routing device is positioned at the surface cleaning machine, between the first end and the second end relative to the axial direction. The cooling air inlet is positioned at the height of the motor housing, relative to the axial direction. This results in optimized capability of supplying intake cooling air to the drive motor with a high degree of protection against splash water.

It is advantageous for the cleaning head to be pivotable relative to the drive motor and in particular to be pivotable relative to a sleeve, in particular wherein the sleeve forms a pivot bearing element. By way of example, this provides an advantageous way of cleaning corner areas because of a pivoting capability of the device body with respect to the at least one cleaning roller. The sleeve itself can be used for flow routing of the cooling air routing device, for example. It is also possible, for example, to use the sleeve for fixing the drive motor to the device body and thereby position the latter outside of the housing.

In particular, the sleeve is connected to the device body in rotationally fixed relation therewith. This provides a simple way of implementing a pivot bearing with rotation capability of the cleaning head relative to the device body.

In an advantageous embodiment, the cooling air routing device is coupled to a suction area of the process air routing device. A corresponding negative pressure prevails in the suction area of the process air routing device. Said negative pressure is created by a fan of the suction unit device. Said negative pressure can be used to drive cooling air through the cooling air routing device. By way of example, this eliminates the need to provide a fan for the drive motor in order to drive cooling air through the cooling air routing device. This makes for a simple construction of the surface cleaning machine, wherein, compared to a drive motor that has to drive a fan, the corresponding drive motor can be sized for lower power and hence with a small mass.

In particular, at least one fluid path of the cooling air routing device opens out into at least one suction path of the process air routing device. This provides an advantageous way of coupling exhaust air from the cooling air routing device into the process air routing device, wherein active cooling of the drive motor can be realized and the necessary suction flow is created through the existing fan of the suction unit device.

In particular, the at least one suction path comprises at least one rib which is associated with a mouth of the at least one fluid path of the cooling air routing device into the at least one suction path. The at least one rib is arranged in the suction path in such a manner that it is effective with respect to preventing liquid droplets from the suction flow from entering the cooling air routing device. In principle, the suction flow in the at least one suction path into which the at least one fluid path of the cooling air routing device is coupled may still contain liquid droplets, whereby liquid droplets from the at least one suction path may, in principle, get into the cooling air routing device. By providing the at least one rib which is in particular arranged upstream of a mouth of the at least one fluid path of the cooling air routing device into the at least one suction path, at least a major portion of liquid droplets can be prevented from entering the cooling air routing device. The at least one rib in a sense acts as a shield.

In order to prevent the ingress of liquid droplets into the cooling air routing device, it is further advantageous for a blocking element for blocking the ingress of droplets from the at least one suction path into the cooling air routing device to be arranged at a mouth of the cooling air routing device into the at least one suction path. The blocking element serves to prevent or at least reduce droplet ingress.

In an exemplary embodiment, the blocking element comprises an area with which it projects into the at least one suction path and is in particular configured as a tube (small tube) and in particular comprises a mouth opening which is oriented at an inclined angle relative to a main flow direction in the at least one suction path. In particular, the at least one mouth opening is oriented at an acute angle with respect to the main flow direction in a manner such that it is "receding", meaning that, with respect to the main flow direction, the distance of the mouth opening increases relative to the main flow direction. In particular, the blocking element is configured as a tube or small tube made of, for example, a rubber material. Via the area projecting into the at least one suction path, the blocking element has a projection which reduces the risk of droplet ingress.

It is further advantageous for the at least one suction path to have opening thereinto at least one drain channel for liquid which in particular leads from an area of junction of the cooling air routing device with the at least one suction path to a collection device for liquid. The at least one drain channel allows liquid to drain off that would otherwise accumulate in this area of the suction path (in particular because of the presence of at least one rib and/or a blocking element which are at least partially positioned in this area). The collection device is then for example a tank device for dirty liquid or a separator. The at least one drain channel prevents liquid from accumulating in the relevant area that could otherwise reach the cooling air routing device.

In particular, the at least one fluid path of the cooling air routing device which opens into at least one suction path of the process air routing device is arranged downstream of the drive motor with respect to a cooling air flow. This makes it possible for exhaust cooling air of the drive motor, i.e., cooling air which has flowed through or past the drive motor and has been heated thereby, to be discharged in an optimized manner.

In particular, the at least one suction path of the process air routing device into which the at least one fluid path of the cooling air routing device opens is located upstream of the fan and in particular upstream of a separator or downstream of the separator, with respect to a suction air flow. By way of an arrangement upstream of the fan, a suction flow of the fan can be utilized in order to provide a cooling air suction flow which drives cooling air through the cooling air routing device. In a downstream arrangement of a separator, the cooling air flow need not pass through the separator.

Advantageously, the suction unit device comprises a fan motor for the fan which is arranged in the housing. The fan motor drives one or more turbine wheels of the fan in order to create a suction flow through which an area at the at least one cleaning roller can be suctioned. Furthermore, it is made possible for a negative pressure to be applied to the cooling air routing device.

It is advantageous for the drive motor to be positioned at the cleaning head or at a transition region from the cleaning head to the housing. It can thereby be mounted at a relatively low position on the surface cleaning machine, relative to a normal cleaning mode of operation thereof. This provides ease of operability for an operator.

It is advantageous for a drive axis of the drive motor and a rotary axis of the at least one cleaning roller to be oriented transversely and in particular perpendicularly to each other. It is thereby possible, for example, to support and drive the at least one cleaning roller centrally and also to achieve freedom of support at edge regions of the at least one cleaning roller. This in turn enables a cleaning effect to be also achieved at edge regions of the at least one cleaning roller.

It is then advantageous for a drive axis of the drive motor and a rotary axis of the at least one cleaning roller to be oriented transversely and in particular perpendicularly to each other.

It is further advantageous for a gear device to be provided for transmitting torque from the drive motor to the at least one cleaning roller. By way of the gear device, it is for example possible to achieve a rotational speed reduction. It is further possible to achieve an angle change with respect to torque guidance. Torque can be transmitted to the cleaning roller at an optimized point.

Furthermore, it is advantageous for the cleaning head to be located at the device body via a joint for pivotal movement about a pivot axis. This provides enhanced cleaning capabilities, in particular in corners and edge areas.

Provision is made for the pivot axis to be oriented transversely with respect to a longitudinal axis of the device body and in particular to be oriented at an acute angle relative to the longitudinal axis and/or for a drive axis of the drive motor to be at least approximately parallel to or coaxial with the pivot axis. This affords extended cleaning capabilities, particularly in corners and edge regions.

It is particularly advantageous for a wetting device to be provided for wetting the at least one cleaning roller with cleaning liquid. The wetting device allows for the at least one cleaning roller to be wetted directly or indirectly. In direct wetting, cleaning liquid is applied to the at least one cleaning roller directly. In indirect wetting, cleaning liquid is applied to the surface that is to be cleaned. The cleaning roller then picks up cleaning liquid from there. With the use of cleaning liquid, dirt on the surface to be cleaned can be broken up for improved pick-up.

It is further advantageous for a tank device for cleaning liquid to be arranged at the device body and/or for a receiving device for dirt and/or a tank device for dirty liquid to be arranged at the device body. This provides enhanced cleaning capabilities with compact construction of the surface cleaning machine.

It is advantageous if, when operated in a cleaning mode, the surface cleaning machine is only supported via the at least one cleaning roller on a surface to be cleaned. This allows the surface cleaning machine to be implemented in a compact manner. Furthermore, user-friendly cleanability can be achieved. For example, when operating in a cleaning mode, an operator need then only provide additional support to the surface cleaning machine at a location spaced apart from the at least one cleaning roller (for example at a hand grip).

It is further advantageous for an inlet for air and/or an outlet for air (a cooling air inlet, a process air inlet, a cooling air outlet, a process air outlet) to comprise one or more slits or to be formed by one or more slits. Such an inlet or outlet can be implemented in a simple manner. It has one or more openings, wherein an opening is formed by a slit.

The following description of preferred embodiments serves in conjunction with the drawings to explain the invention in greater detail.

DETAILED DESCRIPTION OF THE INVENTION

Figure 1:
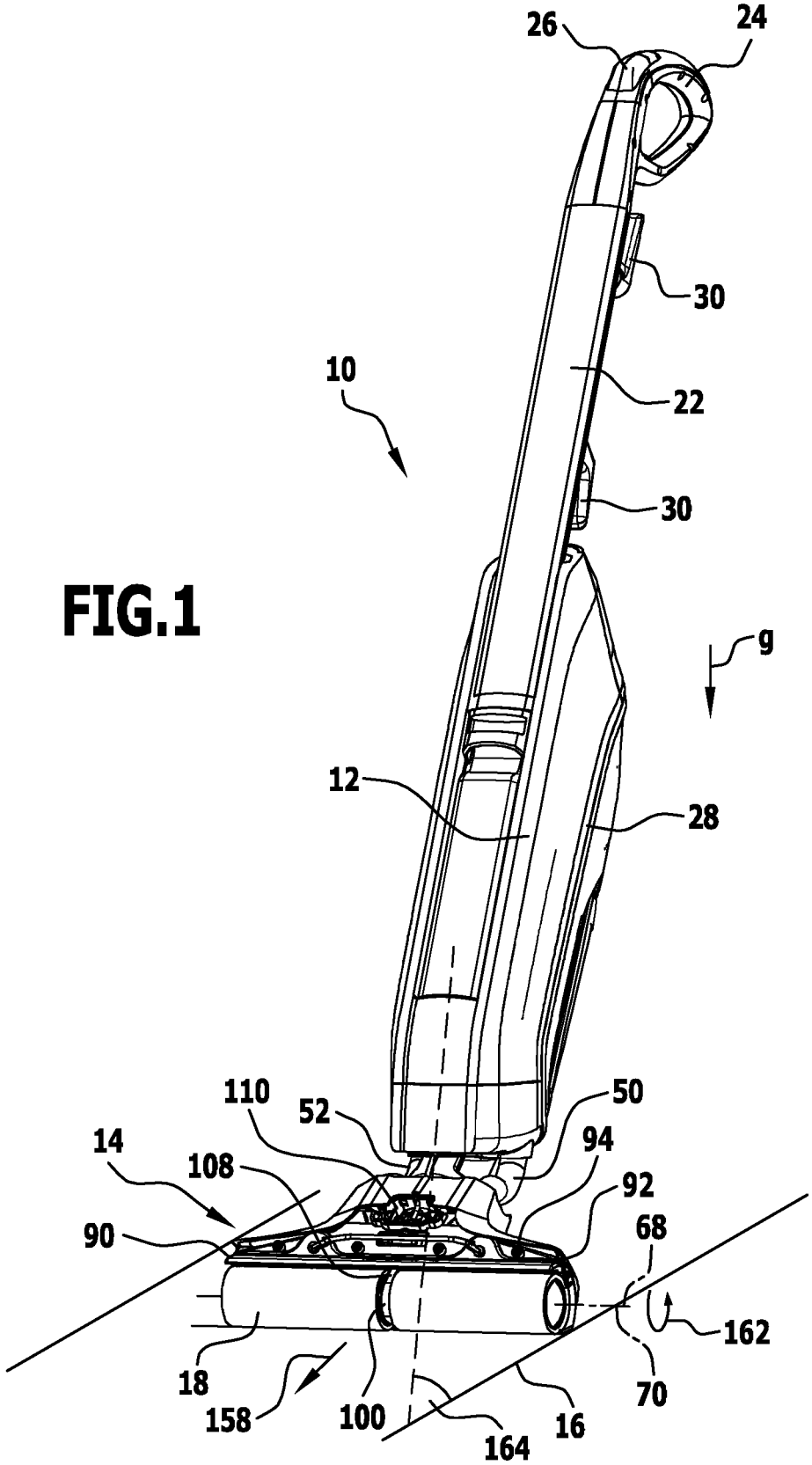
FIG. 1 shows a perspective representation of an exemplary embodiment of a surface cleaning machine in accordance with the invention, shown as placed on a surface to be cleaned for use in a cleaning mode of operation.

An exemplary embodiment of a surface cleaning machine 10 in accordance with the invention (FIGS. 1 to 7) is configured as a floor cleaning machine for hard-surfaced floors.

The surface cleaning machine 10 comprises a device body 12 and a cleaning head 14. The cleaning head 14 is arranged at the device body 12.

In a cleaning operation performed on a surface 16 to be cleaned, the surface cleaning machine 10 is supported on the surface 16 to be cleaned via a cleaning roller 18. In an exemplary embodiment (FIG. 1), a single cleaning roller 18 is provided.

In principle, it is also possible for a plurality of cleaning rollers to be provided.

Figure 2:
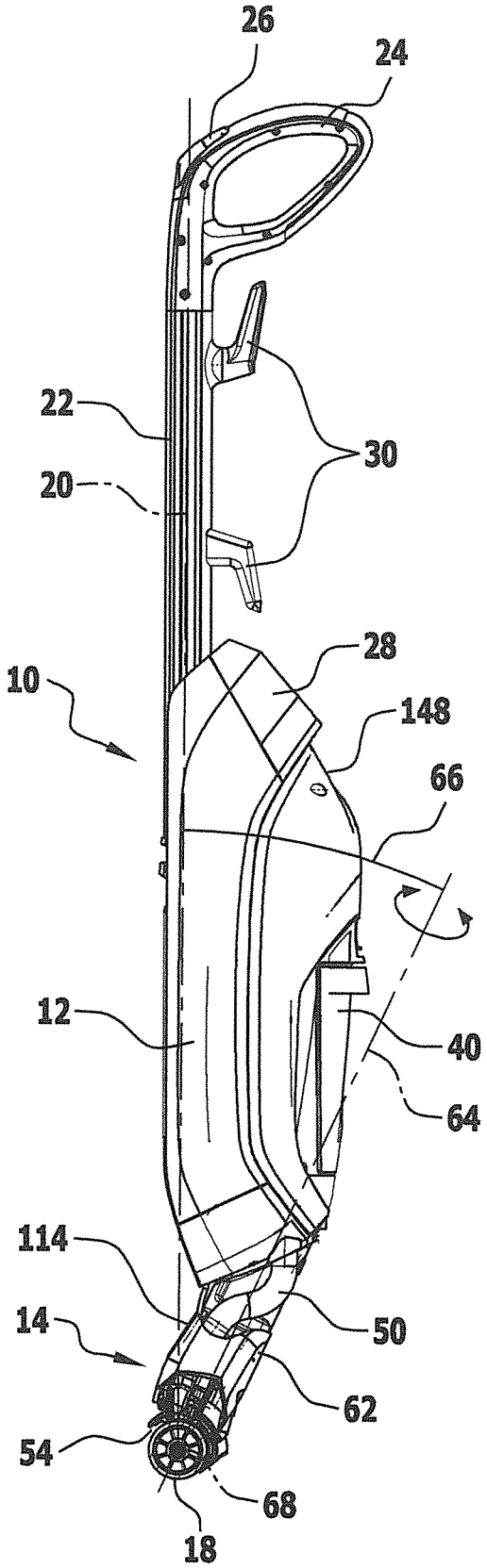
FIG. 2 shows a side view of the surface cleaning machine in accordance with FIG. 1.
Figure 3:
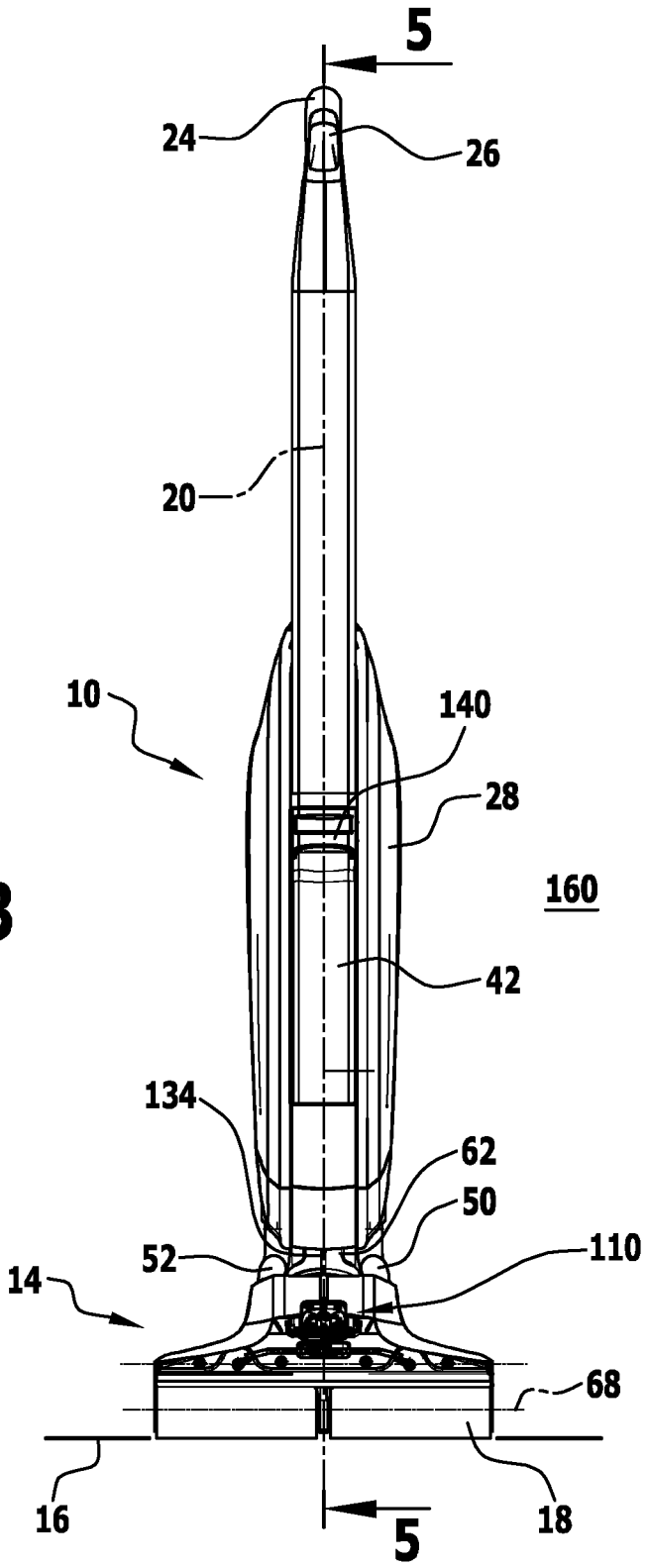
FIG. 3 shows a front view of the surface cleaning machine in accordance with FIG. 1.

The device body 12 has a longitudinal axis 20 (FIGS. 2, 3). The surface cleaning machine 10 is handle-held. To this end, a stick 22 is located at the device body 12. Said stick 22 extends along the longitudinal axis 20. Arranged in an upper portion of the stick 22 is a hand grip 24 and in particular a loop-type hand grip. An operator can hold the surface cleaning machine 10 and manoeuvre it across the surface 16 to be cleaned using one hand by way of the hand grip.

One or more operating controls are arranged at the hand grip 24. In particular, a switch 26 is arranged at the hand grip 24. Via the switch 26, the surface cleaning machine 10 can be switched on for use in a cleaning mode of operation and switched off.

In particular, the surface cleaning machine 10 is controlled such that actuation of the switch 26 causes all of the components required for the mode of operation (generating suction flow through a suction unit device, rotating the cleaning roller 18, direct or indirect wetting of the cleaning roller 18) to be actuated; correspondingly, switching off the switch 26 causes the actuation of these components to be switched off synchronously.

The stick may be arranged for height adjustment along the longitudinal axis 20 or it may be of rigid configuration or rigidly arranged at the device body 12.

The device body 12 comprises a housing 28 in which components of the surface cleaning machine are arranged in a protected manner.

In an exemplary embodiment, a hook device 30 is arranged on the stick 22 at a location between the housing 28 and the hand grip 24, said hook device 30 providing a way of fixing a power cord to the stick 22 by wrapping the cord therearound.

The cleaning head 14 together with the cleaning roller 18 is arranged outside of the housing 28.

The surface cleaning machine 10 comprises a suction unit device generally designated by the reference numeral 32. The suction unit device 32 serves to generate a suction flow in order to be able to perform a suction action at the cleaning roller 18.

The suction unit device 32 comprises a fan (suction fan) 34 which is arranged in the housing 28. The fan 34 itself is driven by a fan motor 36. The fan motor 36 is arranged in the housing 28. It is an electric motor in particular.

The suction unit device 32 has a separator 38 associated therewith. The separator 38 is likewise positioned in the housing 28. The separator separates solid from liquid constituents in a suction stream.

Associated with the separator 38 is a tank device 40 for dirty liquid. Said tank device 40 is removably located at the housing 28.

Figure 4:
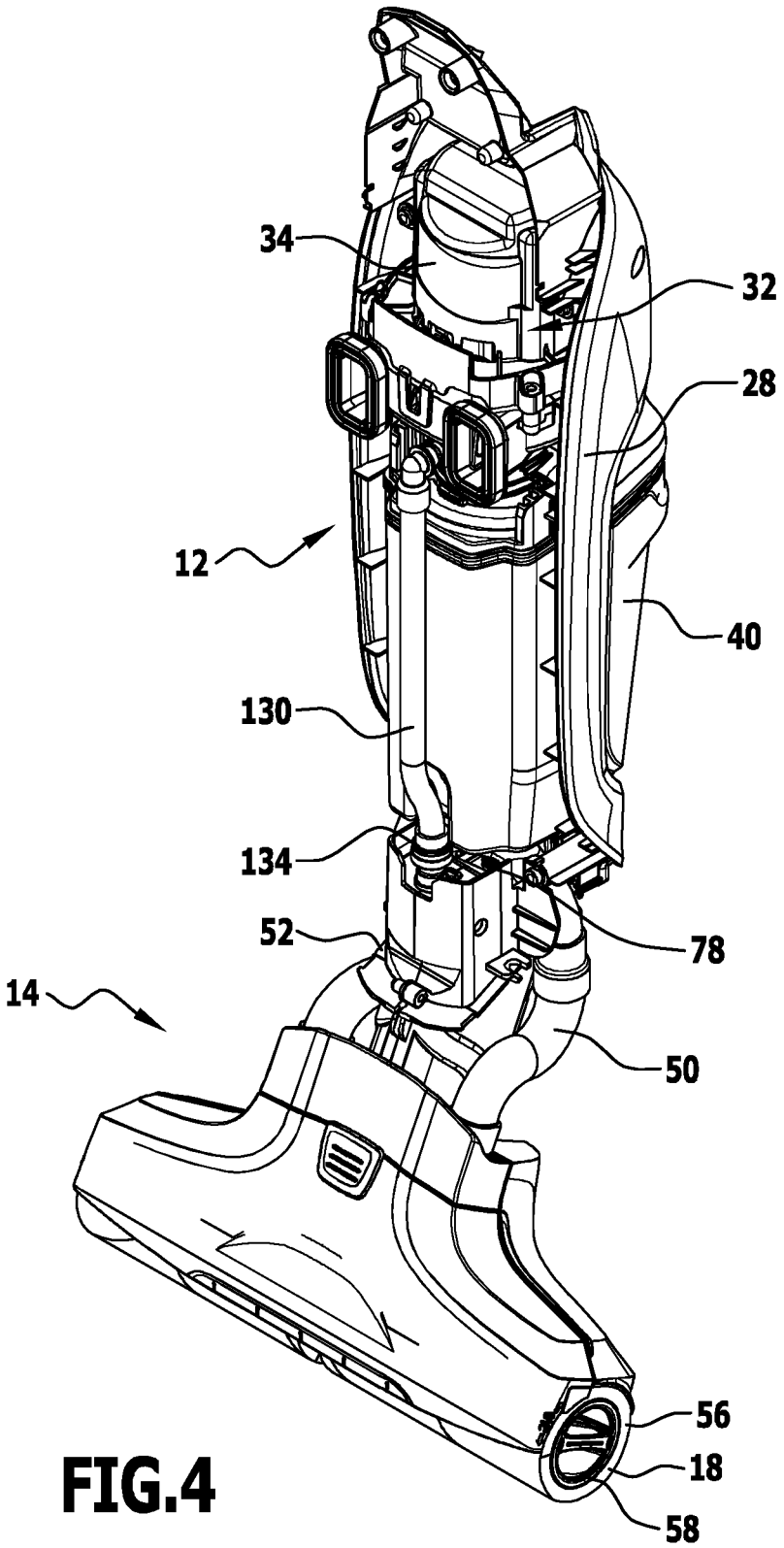
FIG. 4 shows a partial representation of a device body and a cleaning head, with a housing of the device body shown in a partially open state.
Figure 5:
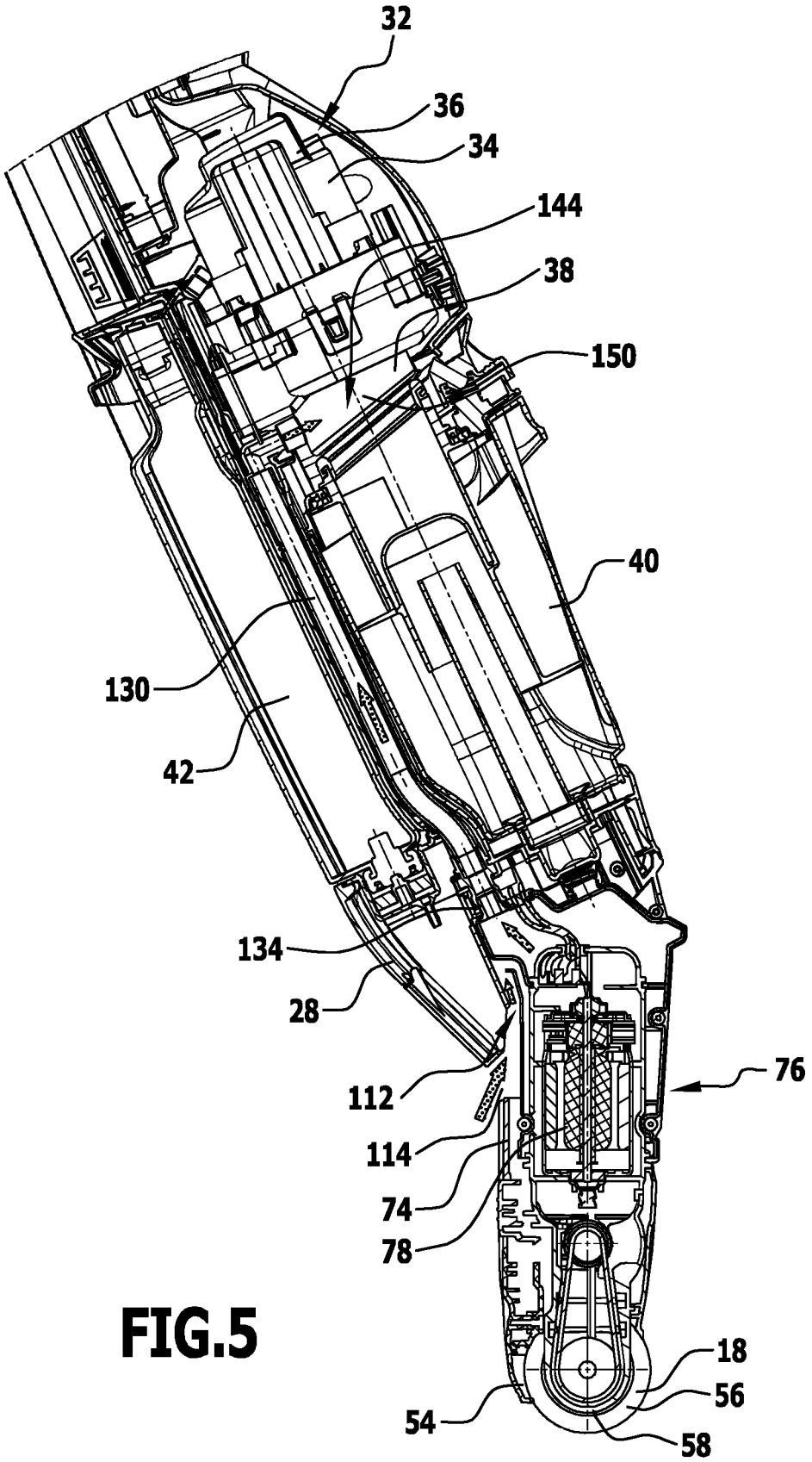
FIG. 5 shows a (partial) side view along line 5-5 in FIG. 3.
Figure 6:
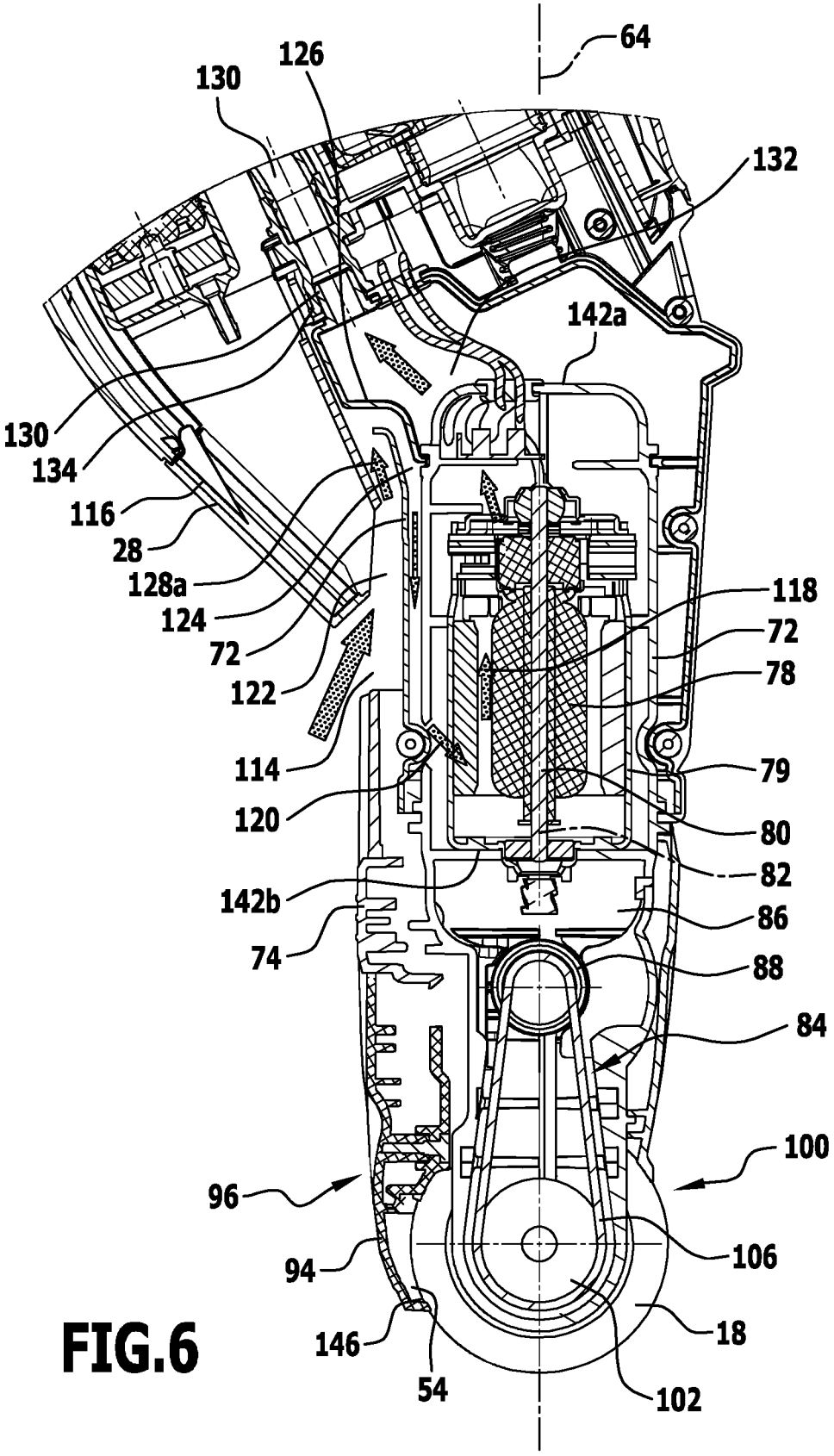
FIG. 6 shows an enlarged representation illustrating an area around a drive motor in FIG. 5.
Figure 7:
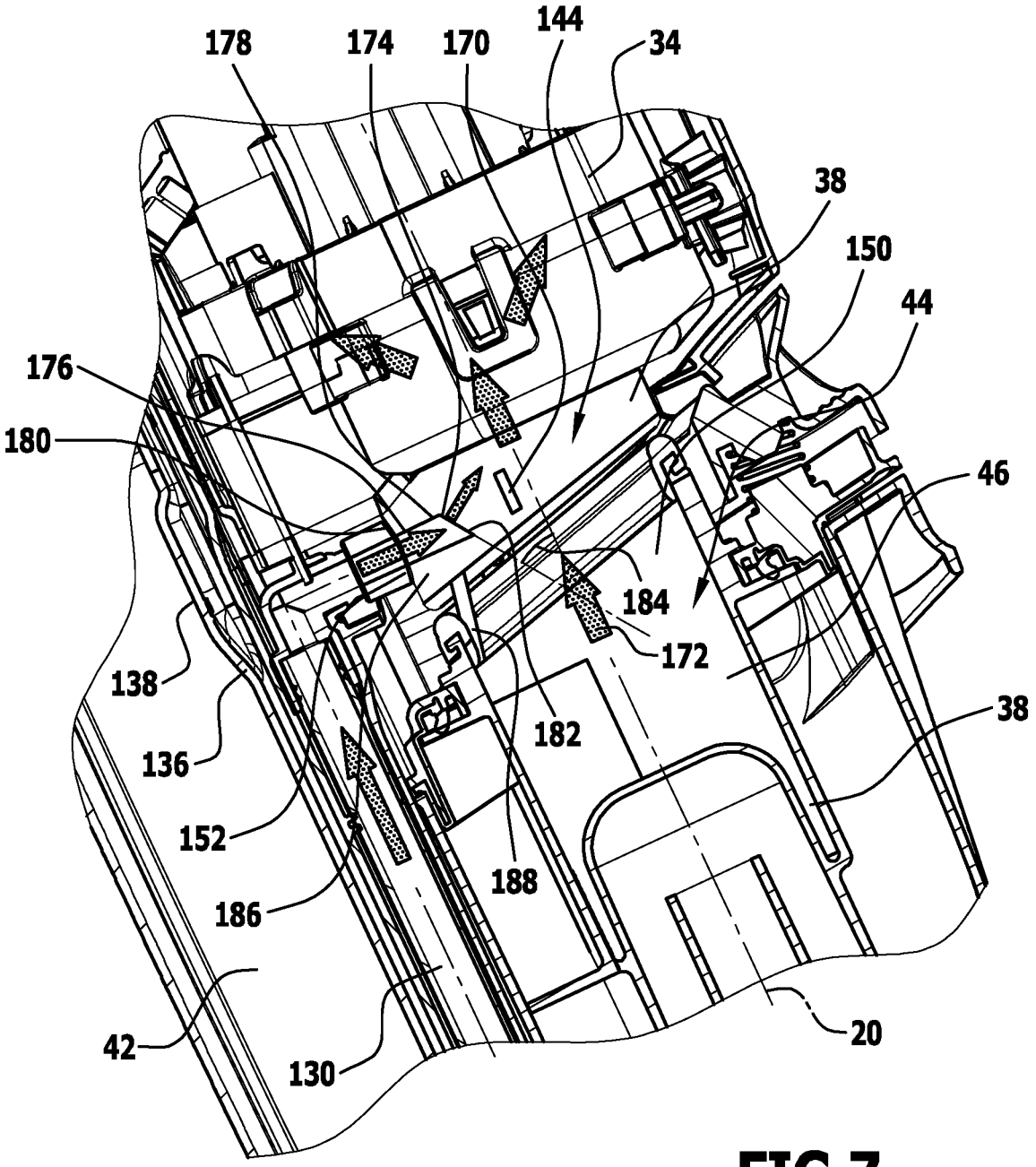
FIG. 7 shows an enlarged representation illustrating an area of a suction unit device in FIG. 5.

Furthermore, a tank device 42 for cleaning liquid is removably located at the housing 28. The cleaning liquid is in particular water or a mixture of water and cleaning agent. (FIG. 4 illustrates a partial representation with the housing 28 shown in an opened state and the tank device 42 removed.)

The suction unit device 32 is operatively connected to (at least) one suction channel 44 (FIG. 7) for fluid communication therewith, said suction channel 44 being routed from the fan 34 at the device body 12 through the housing 28 and to the cleaning head 14.

The suction channel 44 has a first region 46 which is positioned at the housing 28. In an exemplary embodiment, a branch (not visible in the drawings) is located in the housing 28, at the first region 46, said branch branching out into a second region 50 and a third region 52 of the suction channel 44. By way of the branch and the second region 50 and third region 52, the suction channel 44 is split into two sub-channels. The second region 50 and the third region 52 are each routed to the cleaning head 14. The second region 50 and the third region 52 are at least partially located outside the housing 28.

It is in principle also possible for the branch to be located outside of the housing 28. In this case, in particular the second region 50 and the third region 52 are then located completely outside of the housing 28.

At least one suction mouth 54 is arranged at the cleaning head 14, on the side thereof facing towards the cleaning roller 18. For example, at least one suction mouth is arranged in each of the second region 50 and the third region 52.

A cleaning substrate 56 is arranged on the cleaning roller 18. In particular, the cleaning substrate 56 is fixed on a sleeve 58 which has a cylindrical shape.

In an exemplary embodiment, the at least one suction mouth comprises a first mouth wall and a second, spaced-apart mouth wall. The respective suction mouth 54 is formed between the first mouth wall and the second mouth wall. The first mouth wall is located above the second mouth wall when the cleaning roller 18 is placed on the surface 16 to be cleaned. The first mouth wall and/or the second mouth wall are/is in contact against or protrude(s) into the cleaning substrate 56 of the cleaning roller 18. A corresponding mouth configuration is described in WO 2015/086083 A1. This document is incorporated herein and made a part hereof by reference in its entirety and for all purposes.

It is in principle possible for the second region 50 and the third region 52 to have a suction mouth 54 of their own associated therewith, or a common suction mouth for the second region 50 and the third region 52 of the suction channel 44 may be provided. This single one suction mouth 54 then has two suction points across the second region 50 and the third region 52.

It is in principle also possible for the suction channel routing from the suction unit device 32 to the cleaning head 14 to be configured without a branch and to comprise a plurality (in particular two) suction channels which are then routed from the housing 28 to the cleaning head 14.

The cleaning head 14 is held to the device body 12 outside of the housing 28 via a joint 62 for pivotal movement about a pivot axis 64 (FIG. 2). The pivot axis 64 lies transversely with respect to the longitudinal axis 20 of the device body 12. It is in particular at an acute angle 66 (FIG. 2). The acute angle 66 is in the range between 15° and 35° in particular.

In an exemplary embodiment, the acute angle 66 is approximately 25°.

The pivot axis 64 extends transversely and in particular perpendicularly with respect to an axis of rotation 68 of the cleaning roller 18.

The cleaning roller 18 has a longitudinal axis 70. The longitudinal axis 70 is in particular coaxial with respect to the axis of rotation 68.

The pivot joint comprises a(n internal) sleeve 72 (FIGS. 6 and 7) which, correspondingly to the orientation of the pivot axis 64, is arranged at the device body 12 at the acute angle 66 with respect to the longitudinal axis 20. Said internal sleeve 72 is in particular rigidly fixed to the device body 12.

The cleaning head 14 comprises an external sleeve 74 which is supported on the internal sleeve 72. A corresponding blocking device provides for the external sleeve 74 to be non-displaceable relative to the internal sleeve 72 in a direction of the pivot axis 64. In an embodiment, the internal sleeve 72 has a cylindrical outer contour. The external sleeve 74 has a cylindrical inner contour. The joint 62 is configured as a sliding joint, wherein the external sleeve 74 is rotatably supported on the internal sleeve 72.

In principle, provision may be made for a pivoting capability through a full 360° angle. In an exemplary embodiment, the pivoting capability is limited to a range around ±45° or ±90°, for example.

A fluid conduit which forms the second region 50 and the third region 52 is configured with an appropriate elasticity, and in particular as a hose, in order to permit pivoting of the cleaning head 14 on the joint 62.

A drive device 76 comprising a drive motor 78 is provided for imparting rotational drive to the cleaning roller 18. The drive motor 78 is in particular an electric motor.

The drive motor 78 comprises a motor housing 79. The corresponding components of the drive motor (in particular a rotor and a stator) are arranged in the motor housing 79. The motor housing 79 is positioned in the internal sleeve 72.

The drive motor 78 comprises a motor shaft 80. The motor shaft 80 has a drive axis 82. The drive axis 82 is parallel to and in particular coaxial with the pivot axis 64.

The drive motor 78 together with its motor housing 79 is fixedly located in the internal sleeve 72 and is thereby fixed to the device body 12. It is placed at a transition from the device body 12 to the cleaning head 14; it is positioned at the joint 62. It is accommodated in space-conserving relationship and is therefore also located at the cleaning head 14. It is located in the vicinity of the cleaning roller 18 relative to a centre of gravity of the surface cleaning machine 10.

The drive motor 78 is supplied with electrical energy through current drawn from the mains grid for example.

The drive axis 82 of the drive motor 78 and the axis of rotation 68 of the cleaning roller 18 are oriented transversely with respect to one another and in particular are oriented perpendicularly to one another.

The drive device 76 comprises a gear device 84 for transmitting torque from the drive motor 78 to the cleaning roller 18.

In an exemplary embodiment, the gear device 84 comprises a rotational speed reducer 86. The rotational speed reducer 86 provides for a reduction in rotational speed as compared to the rotational speed of the motor shaft 80.

The drive motor 78 is for example a standard-type electric motor having, for example, a(n initial) rotational speed of the order of magnitude of 7,000 revolutions per minute. By way of example, the rotational speed reducer 86 provides for a reduction in rotational speed down to approximately 400 revolutions per minute.

In particular, the rotational speed reducer 86 is arranged directly at the drive motor 78, i.e., is arranged immediately next thereto as seen in the direction of the cleaning roller 18. It may be still located inside the internal sleeve 72 or it may be located outside the internal sleeve 72.

In an exemplary embodiment, the rotational speed reducer 86 is configured as a planetary gear mechanism.

Furthermore, the gear device 84 of the drive device 76 comprises an angular gear 88. This provides for redirection of torque in order to effect driving of the cleaning roller 18 with the axis of rotation 68 transverse to the drive axis 82 of the drive motor 78. In particular, the angular gear 88 is arranged downstream of the rotational speed reducer 86.

In an exemplary embodiment, the angular gear 88 comprises one or more gear wheels which are coupled to a corresponding shaft of the rotational speed reducer 86 in rotationally fixed relation thereto. These gear wheels act on a bevel gear for changing the angle.

The cleaning head 14 has a first end face 90 and a second end face 92 opposite thereto (cf. FIG. 1). Extending between the first end face 90 and the second end face 92 is a housing 94 of a cleaning roller holder 96. The housing 94 partly engages, in the form of a half-shell, around a cleaning roller 18 held thereto, wherein an engagement therearound is such that a significant proportion of the cleaning substrate 56 on cleaning roller 18 projects out for a cleaning operation and correspondingly the cleaning substrate 56 is allowed to come into contact with the surface 16 to be cleaned.

In an exemplary embodiment, a sweeping element is arranged at the housing 94 of the cleaning roller holder 96 which serves to sweep coarse dirt inwardly in order for it to be taken up by the cleaning roller.

A drive element 102 is arranged in a central region 100 of the cleaning roller holder 96 that is centrally located between the first end face 90 and the second end face 92. In particular, said drive element 102 is connected to a shaft 104 of the cleaning roller 18 or is itself the shaft 104. The drive element 102 is operatively connected to the gear device 84 for torque transmission.

In an exemplary embodiment, the drive element 102 is coupled to the angular gear 88 via a belt 106. The drive element 102 is at a distance from the angular gear 88. The belt 106 spans said distance and causes drive to be imparted to the drive element and, therefore, rotation of the cleaning roller 18 about the axis of rotation 68.

In an exemplary embodiment (cf. FIG. 1), the cleaning roller is of two-piece configuration comprising a first part and a second part. The first part and the second part are each mounted on the shaft 104, wherein they are spaced apart relative to each other in the central region 100. The central region is devoid of cleaning substrate 56. A gap 108 is formed at the cleaning roller 18. Said gap 108 is of relatively narrow configuration and is of very much less width than a length of the cleaning roller 18 along the longitudinal axis 20. The belt 106 is guided in the gap 108. The belt 106 is set back from an outer face of the cleaning roller 18, even relative to a position in which the cleaning substrate 56 is compressed because of the cleaning roller 18 having been placed on the surface 16 to be cleaned.

The surface cleaning machine 10 comprises a wetting device 110 for wetting the cleaning roller 18. Via the wetting device 110, cleaning liquid can be applied to the cleaning roller 18 directly or indirectly. In direct application, cleaning liquid is directly applied from the tank device 42 to the cleaning roller 18 (to the cleaning substrate 56 thereof). In indirect application, cleaning liquid is applied to the surface 16 that is to be cleaned. The cleaning substrate 56 of the cleaning roller 18 then picks up the cleaning liquid from the surface 16 to be cleaned. In principle, direct application alone, indirect application alone or a combination of direct application with indirect application may be provided.

An exemplary embodiment of a wetting device which is coupled to the suction unit device 32 is described in German Patent Application No. 10 2014 114 809.6 filed Oct. 13, 2014, not pre-published, or in US 2017-0215676.

In particular, the wetting device comprises at least one pressure-controlled switch which, in an open position, opens a fluid path for cleaning liquid to the at least one cleaning roller and, in a closed position, blocks said fluid path, wherein the at least one pressure-controlled switch is operatively coupled to the suction channel 44 for pressure communication therewith and wherein, when a negative pressure is applied by a suction flow in the at least one suction channel, the at least one pressure-controlled switch goes to the open position and/or maintains the open position.

This application is incorporated herein and made a part hereof by reference in its entirety and for all purposes.

The drive motor 78 is air-cooled. A cooling air routing device, generally indicated at 112, is provided for routing the cooling air (FIGS. 5 to 11).

The cooling air routing device 112 comprises a cooling air inlet 114. At the cooling air inlet 114, air is coupled into the surface cleaning machine for cooling the drive motor 78.

The cooling air inlet 114 is formed by one or more openings which are for example configured in the form of slits.

In an exemplary embodiment, the cooling air inlet 114 is formed at a transition region from the housing 28 to the cleaning head 14 and in particular to the external sleeve 74.

The cooling air inlet 114 is thereby bounded to one side by the housing 28 and to the other side by the external sleeve 74.

The area of the housing 28 that bounds the cooling air inlet 114 or at which the cooling air inlet is formed is in particular an area 116 which holds the tank device 42 for cleaning liquid.

In particular, the cooling air inlet 114 is arranged at a transition region from the housing 28 to the cleaning head 14.

The cooling air routing device 112 comprises one or more fluid paths 118 through the motor housing 79 formed by a corresponding one or more channels. Correspondingly, an inlet 120 at the motor housing 79 is operatively connected to the cooling air inlet 114 for fluid communication therewith.

In an exemplary embodiment, the cooling air routing device 112 comprises a single first channel 122 or a plurality of first channels 122 which is/are connected directly to the cooling air inlet 114 and extend(s) in a direction of the housing 28. The one or more channels 122 are bounded to one side by the internal sleeve 72.

Furthermore, one or more second channels 124 are provided which extend at least approximately parallel to the one or more first channels 122. Arranged between the one or more first channels 122 and the one or more second channels 124 is an area of directional change 126. The one or more second channels 124 are located between the internal sleeve 72 and the motor housing 79. The one or more inlets 120 to the motor housing 79 are located at the one or more second channels 124.

At least one first fluid path **128*a* is provided by the one or more first channels 122. At least one second fluid path 128*b* is provided by the one or more second channels 124. A main flow in the second fluid path 128*b* is at least approximately indirectly parallel to a main flow in the first fluid path 128*a*. Cooling air is coupled from the exterior into the first fluid path 128*a* via the cooling air inlet 114. Flow from the first fluid path 128*a* is deflected in the area of directional change 126 into the second fluid path 128*b*. From there, cooling air is coupled into the motor housing 79 via the inlet 120**.

The cooling air routing device 112 further comprises at least one channel 130 which is routed from the drive motor 78, on the exhaust side thereof, to the device body 12 and is thereby routed through the housing 28.

In particular, the (at least one) channel 130 is oriented parallel to the longitudinal axis 20.

In an exemplary embodiment, it is arranged at the device body 12, inside the housing 28, behind the tank device 42 for cleaning liquid (cf. FIG. 4). When the tank device 42 for cleaning liquid is positioned on the device body 12, then said at least one channel 130 is covered towards a front side of the surface cleaning machine 10 (cf. FIG. 7).

Provision may be made for the drive motor 78 and in particular the motor housing 79 to have arranged thereat a collector 132 for cooling air which has passed through the drive motor 78. The channel 130 is then connected to the collector 132.

By way of example, the collector 132 is configured in the shape of a funnel towards a connection 134 for the channel 130.

The channel 130 of the cooling air routing device 112 is operatively connected to a cooling air outlet 136 for fluid communication therewith. The cooling air outlet 136 comprises one or more openings which are configured, for example, in the form of slits. "Expended" cooling air, which has been heated by flowing past the drive motor 78, is discharged to the environment.

In an exemplary embodiment, provision is made for the cooling air outlet 136 to be positioned in an upper area 138 of the housing 28 and in particular at a height that is level with or above of a top side 140 of the tank device 42 for cleaning liquid.

The channel 130 in a sense provides a suction snorkel through which heated cooling air is discharged to the environment at a relatively large distance from the drive motor 78.

The motor housing 79 extends axially (parallel to the drive axis 82) between a first end **142*a* and a second end 142*b*. The cooling air inlet 114, as seen relative to said axial direction between the first and second ends 142*a*, 142*b*, is located at the height of the drive motor 78, i.e., it is located in a transverse plane with respect to the drive axis 82, wherein said transverse plane is positioned between the first end 142*a* and the second end 142*b***.

When the surface cleaning machine 10 is placed on the surface 16 to be cleaned and is held by an operator by way of the hand grip 24, the cooling air outlet 136 is located spaced-apart from the cooling air inlet 114, wherein the distance of the cooling air outlet 136 from the surface 16 to be cleaned is a multiple of the distance of the cooling air inlet 114 from the surface 16 to be cleaned.

In particular, the distance between the cooling air outlet 136 and the axis of rotation 68, with respect to the longitudinal axis 20, is at least three times the distance of the cooling air inlet 114 from the axis of rotation 68 with respect to the longitudinal axis 20.

In a preferred exemplary embodiment, the cooling air routing device 112 is coupled to a process air routing device 144 of the suction unit device 32. The process air routing device 144 comprises a process air inlet 146. Said process air inlet 146 is formed via the one or more suction mouths 54.

The process air routing device 144 further comprises the one or more suction channels which lead from the one or more suction mouths 54 to the fan 34.

In the exemplary embodiment illustrated, the process air routing device 144 comprises the suction channel 44 having the regions 46, 50 and 52.

The process air routing device further comprises a process air outlet 148 which is in particular arranged at the housing 28 in the area of the fan 34.

The process air outlet 148 comprises one or more openings which are configured in the form of slits in particular. "Expended" process air is discharged to the environment via the process air outlet 148.

The process air routing device 144 comprises (at least) one suction path 150 which has negative pressure conditions prevailing therein when operating in a cleaning mode. The at least one suction path 150 is formed in the first region 46 in particular.

Provision is made for the cooling air routing device 112 to be coupled to the process air routing device 144.

The cooling air routing device 112 and the process air routing device 144 thereby comprise one or more common fluid paths.

It is provided for at least one of the inlets or outlets to be omitted. In the exemplary embodiment illustrated, a cooling air outlet is then formed by the process air outlet 148. A separate cooling air outlet need no longer be provided.

The at least one channel 130 opens out into the suction channel 44 and thereby into the suction path 150.

In particular, a corresponding mouth region 152 is located at the height of the suction unit device 32 in particular.

In an exemplary embodiment, said mouth region 152, which is a region for coupling the cooling air routing device 112 into the process air routing device 144, is located downstream of the separator 38. With this arrangement, cooling air formed by a pure air stream need not pass through the separator 38.

In principle, it is also possible for the corresponding coupling-in point (the mouth region 152) to be located upstream of the separator 38.

In an exemplary embodiment, at least one rib 170 is positioned in the suction path 150, in associated relation to the mouth region 152. By way of example, the rib 170 is oriented parallel to a main flow direction of the suction flow in the suction path 150, wherein the main flow direction is in particular substantially parallel to the longitudinal axis 20.

The rib 170 is arranged and configured such that the ingress of liquid droplets from the suction path 150 into the cooling air routing device 112 is influenced and is in particular influenced in such a way that fewer droplets are allowed to enter the cooling air routing device 112 at the mouth region 152.

The suction flow in the suction path 150 may contain liquid droplets. The goal is to prevent as much as possible the ingress of liquid droplets from the suction flow into the cooling air routing device 112 at the mouth region 152.

The rib 170 represents a kind of shield which, to a certain extent, shields a mouth 174 of the mouth region 152.

Advantageously, the rib 170 may be arranged and configured such that a flow of air from the cooling air routing device 112 is guided and in particular deflected by the rib 170 as it flows into the suction path 150.

A blocking element 176 is arranged at the mouth region 152. The blocking element 176 is connected in the mouth region 152 to the channel 130 and comprises an area 178 via which it projects into the suction path 150. Said area 178 forms a projection of the cooling air routing device 112 into the suction path 150.

The blocking element 176 is for example a tube (small tube). It is preferably made of a rubber material. The mouth 174 of the cooling air routing device 112 is located at the area 178 of the blocking element 176. The mouth 174 is thereby spaced from a wall 180 at which the channel 130 terminates. It projects into the suction path 150.

The rib 170 is associated with the mouth 174. It is arranged and configured such that the main flow of the suction flow in the main flow direction 172 is not admitted directly to the mouth 174.

A mouth opening 182 of the mouth 174 is oriented at an inclined angle with respect to the main flow direction 172; it is oriented at an acute angle 184. The orientation is such that the distance from the main flow direction 172 (or the longitudinal axis 20) increases in the main flow direction 172. In a sense, the mouth opening 182 points away from the main flow in the main flow direction 172.

The blocking element 176 also provides for the risk of liquid droplets entering the cooling air routing device 112 (the channel 130) to be reduced.

A drain channel 188 for liquid opens out to an area 186 (junction area) of the suction path 150 that is located at the mouth region 152. When, in a normal mode of operation, the surface cleaning machine 10 is supported via the cleaning roller 18 on the surface 16 to be cleaned, the drain channel 188 leads away from the junction area 186, downwardly relative to the direction of gravity. The drain channel 188 enables liquid that would otherwise accumulate in the area 186 to drain therefrom. This also reduces the risk of liquid from the suction path 150 entering the cooling air routing device 112.

The drain channel 188 leads to a collection device for liquid. The collection device for liquid may be a collector which is correspondingly operatively connected to the tank device 40 for dirty liquid for fluid communication therewith, or the tank device 40 itself may represent such a collection device. It is also possible for the drain channel 188 to lead to the separator 38 or to a fluid path of the suction unit device 32 which is located upstream of the suction path 150, wherein a separator stage is correspondingly interposed therebetween.

The (at least one) rib 170, the blocking element 176 and the drain channel 188 contribute to greatly reducing the risk of liquid droplets from the suction flow in the suction path 150 entering the cooling air routing device 112 at the mouth region 152.

Downstream of said mouth region 152, the process air routing device 144 and the cooling air routing device 112 have the same fluid paths.

The fan 34 forms a drive for the cooling air to flow through the cooling air routing device 112. Driven by the fan 34, cooling air is drawn through the cooling air routing device 112 via the mouth region 152 which opens into the suction path 150.

In the above-mentioned example in which the cooling air outlet 136 is separate from the process air routing device 144, the drive motor 78 in particular comprises a fan for cooling air in order to drive cooling air through the cooling air routing device 112.

Figure 8:
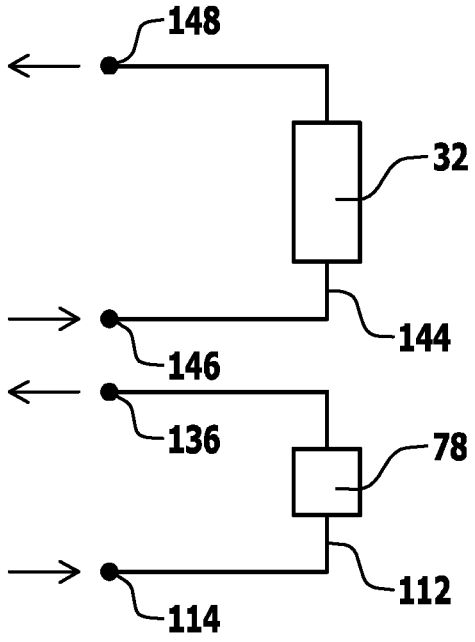
FIG. 8 shows a schematic representation of a cooling air routing device for a drive motor and a process air routing device of a suction unit device when these are not coupled together.

Schematically shown in FIG. 8 is an arrangement in which the cooling air routing device 112, which is associated with the drive motor 78, and the process air routing device 144, which is associated with the suction unit device 32, are completely separate from one another.

Figure 9:
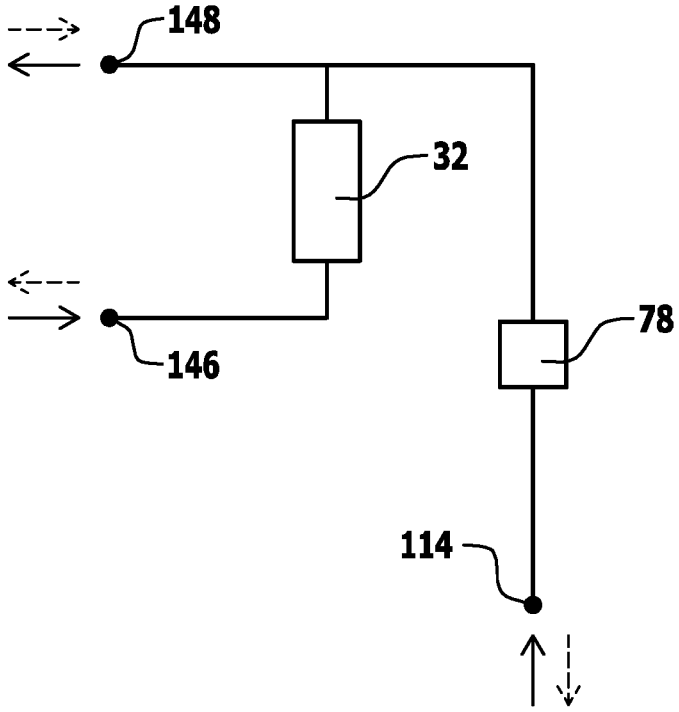
FIG. 9 shows a schematic exemplary embodiment of a solution in accordance with the invention in which the cooling air routing device and the process air routing device are coupled together.

FIG. 9 schematically illustrates the above-described solution in accordance with the invention. Cooling air is coupled via the cooling air inlet 114 into the surface cleaning machine 10 and supplied to the drive motor 78 to provide air-cooling thereto. Exhausted cooling air is coupled into the process air routing device 144 and, together with process air, coupled out at the process air outlet 148.

In principle, the direction of flow can be reversed; this is illustrated in FIG. 9 by the arrows shown in broken lines. It is in principle possible for a common inlet for cooling air and process air to be provided instead of a common outlet for cooling air and process air. In this case, cooling air is coupled out from the process air and supplied to the drive motor 78. The above-described cooling air inlet 114 then forms a cooling air outlet.

Figure 10:
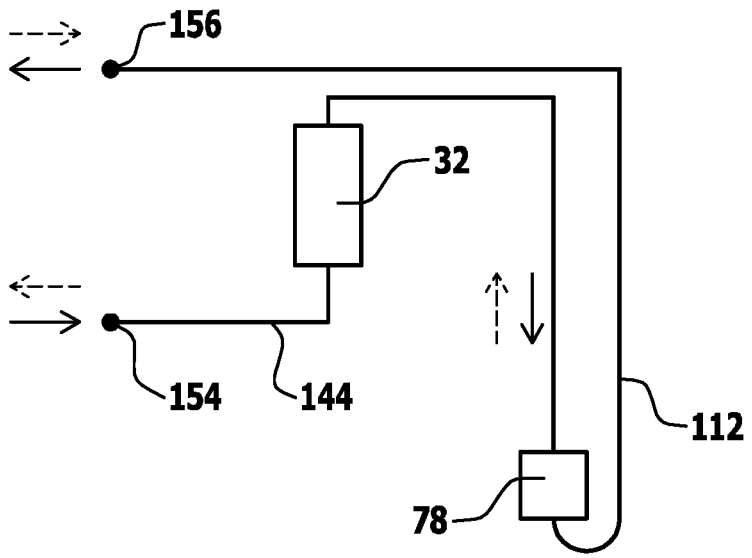
FIG. 10 shows a second exemplary embodiment of a solution in accordance with the invention, with the cooling air routing device in coupled relationship to the process air routing device.

It is in principle also possible, as indicated in FIG. 10, for the corresponding system of air routing comprising the cooling air routing device 112 and the cooling air inlet 114 to comprise only a single inlet 154 and only a single outlet 156. Air is coupled in via the inlet and is first used as process air. This air is then supplied to the drive motor 78 as cooling air and discharged back into the environment at the outlet 156.

In principle, here the direction of flow can also be reversed, meaning that the roles of inlet 154 and outlet 156 are reversed. Air is first coupled in and is then supplied to the drive motor 78 as cooling air. Correspondingly, air exhausted from the drive motor 78 is then used as process air for the suction unit device 32.

Figure 11:
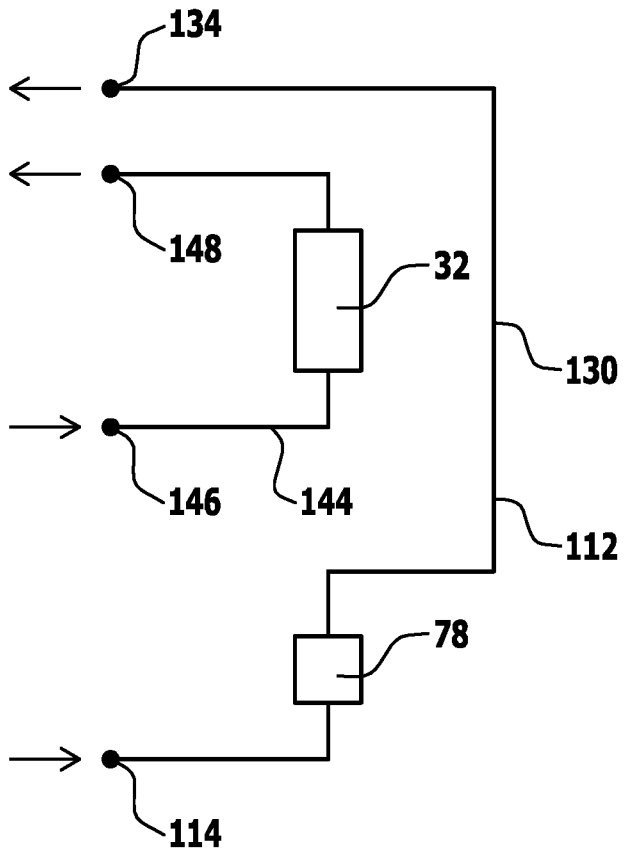
FIG. 11 shows a further schematic exemplary embodiment for a relative positioning of the cooling air routing device and the process air routing device.

FIG. 11 schematically shows the exemplary embodiment comprising the cooling air outlet 136. The channel 130 allows, in the manner of a snorkel, the outlet 136 to be positioned at a large distance from the cooling air inlet 114.

A kind of bypass cooling of the drive motor 78 is enabled by the solution in accordance with the invention.

In particular, cooling air from the drive motor 78 is coupled into the process air routing device 144. The fan 34 of the suction unit device 32 provides for corresponding suctioning of cooling air from the cooling air routing device 112. Exhaust air from the drive motor 78 is coupled into the process air routing and, together with process air exhaust, discharged to the environment.

By way of the solution in accordance with the invention, the number of openings that are required for cooling air can be kept low in the immediate vicinity of the cleaning head 14. A high degree of protection against splash water is thereby achieved.

In the embodiment in which the cooling air routing device 112 is coupled to the process air routing device 144, the fan 34 together with its fan motor 36 can provide a suction drive via which the drive motor 78 can be actively cooled by cooling air. The corresponding process air outlet 148 is also a cooling air outlet which can be positioned far away from the cleaning roller 18 at the surface cleaning machine (relative to a cleaning mode of operation). A high degree of protection against splash water can thereby be achieved. (The outlet region of the process air routing device 144 is already configured for resistance to wetness.)

The solution in accordance with the invention enables a cooling air outlet to be positioned far away from the cleaning roller 18 and, when operating in normal cleaning mode, far away from the surface 16 to be cleaned. In principle, is also possible for the number of outlets to be reduced when a cooling air outlet coincides with a process air outlet.

The driven propulsion of the cooling air through the cooling air routing device 112 by use of the fan 34 eliminates the need to provide a fan for the drive motor 78. It is thereby possible for the drive motor 78 to be sized for reduced power consumption and in particular also with a smaller mass.

The surface cleaning machine 10 in accordance with the invention works as follows:

For operating in a cleaning mode, the surface cleaning machine 10 is supported on the surface 16 to be cleaned via the cleaning roller 18, as shown in FIG. 1. An operator stands on the surface 16 to be cleaned, behind the surface cleaning machine 10, and holds the latter for example with one hand by the hand grip 24.

The operator can perform a forward push stroke in the forward direction 158.

In a cleaning mode of operation, the fan 34 generates a suction flow which gives rise to a negative pressure, relative to the exterior space 160, in the suction channel 44 and therefore in the regions 46, 50 and 52.

In a variant in which the cooling air routing device 112 is coupled to the process air routing device 144, said suction flow also causes cooling air to be suctioned at the cooling air inlet 114 and flowed through the cooling air routing device 112 which opens out into the suction path 150 in the mouth region 152.

The drive motor 78 creates a torque which is transmitted via the gear device 84 to the cleaning roller 18. The latter is driven in rotation. It is in particular driven in rotation in a counterclockwise direction (indicated by the reference numeral 162 in FIG. 1).

In principle, provision may be made for a circumferential speed of the cleaning roller to be adjustable by an operator or to be fixedly predetermined.

The cleaning roller 18 comprises the cleaning substrate 56 which is compressible. In particular, the cleaning substrate 56 is made of a textile material.

For example, the cleaning roller 18 is directly wetted with cleaning liquid from the tank device 42 by way of the wetting device 110. In an exemplary embodiment, such application of liquid uses no pump and, in particular, uses no solenoid valve.

By predetermining an angular position 164 (cf. FIG. 1), an operator can realize a corresponding adjustment in order, for example, to enable cleaning under furniture or the like.

Dirt on the surface to be cleaned is softened up by cleaning liquid and can then be picked up by the cleaning roller 18.

Suctioning is realized via the process air inlet 146 (the one or more suction mouths 54) by way of the induced suction flow. Separation of solid dirt particles from the liquid is realized at the separator 38. Dirty liquid is collected in the tank device 40.

By way of example, the joint 62 also makes it possible to perform corner cleaning or edge cleaning by machine. The device body 12 can be pivoted, relative to the cleaning head 14, in the pivot range about the pivot axis 64.

The relatively heavy drive motor 78, relative to a normal mode of operation, is arranged far down close to the cleaning roller 18 and is positioned at least partially at the joint 62 for space conservation. A cooling air outlet, in turn, can be positioned at a large distance from the cleaning roller 18.

Coarse dirt can be swept via a sweeping element and can then be picked up by the cleaning roller 18.

REFERENCE SYMBOL LIST

10 surface cleaning machine
12 device body
14 cleaning head
16 surface to be cleaned
18 cleaning roller
20 longitudinal axis
22 stick
24 hand grip
26 switch
28 housing
30 hook device
32 suction unit device
34 fan
36 fan motor
38 separator
40 tank device for dirty liquid
42 tank device for cleaning liquid
44 suction channel
46 first region
50 second region
52 third region
54 suction mouth
56 cleaning substrate
58 sleeve
62 joint
64 pivot axis
66 acute angle
68 axis of rotation
70 longitudinal axis
72 (internal) sleeve
74 (external) sleeve
76 drive device
78 drive motor
79 motor housing
80 motor shaft
82 drive axis
84 gear device
86 rotational speed reducer
88 angular gear
90 first end face
92 second end face
94 housing
96 cleaning roller holder
100 central region
102 drive element
104 shaft
106 belt
108 gap
110 wetting device
112 cooling air routing device
114 cooling air inlet
116 area
118 fluid path
120 inlet
122 first channel
124 second channel
126 area of directional change
128*a* first fluid path
128*b* second fluid path
130 channel
132 collector
134 connection
136 cooling air outlet
138 upper area
140 top side
142*a* first end
142*b* second end
144 process air routing device
146 process air inlet
148 process air outlet
150 suction path
152 mouth region
154 inlet
156 outlet
158 forward direction
160 exterior space
162 counterclockwise direction
164 angular position
170 rib
172 main flow direction
174 mouth
176 blocking element
178 area
180 wall
182 mouth opening
184 acute angle
186 area
188 drain channel

The invention claimed is:

1. A surface cleaning machine, comprising:

a device body having a housing;

a suction unit device having a fan, said suction unit device being arranged in the housing;

a cleaning head which is arranged at the device body outside of the housing and comprises at least one cleaning roller and is operatively connected to the suction unit device for fluid communication therewith;

an air-cooled drive motor for rotatingly driving the at least one cleaning roller; and a process air routing device for process air of the suction unit device;

wherein the drive motor is arranged outside of the housing of the device body and wherein at least one of (i) a cooling air routing device for cooling air of the drive motor comprises at least one fluid path which is arranged at or in the housing and (ii) the cooling air routing device is coupled to the process air routing device, and wherein a wetting device for wetting the at least one cleaning roller with cleaning liquid is provided.

2. The surface cleaning machine in accordance with claim 1, wherein the process air routing device and the cooling air routing device comprise at least one common fluid path.

3. The surface cleaning machine in accordance with claim 1, wherein the cooling air routing device comprises a cooling air inlet and a cooling air outlet and wherein the process air routing device comprises a process air inlet and a process air outlet and wherein at least one of (i) the cooling air inlet and the process air inlet coincide and (ii) the cooling air outlet and the process air outlet coincide.

4. The surface cleaning machine in accordance with claim 3, wherein at least one of (i) the process air outlet forms the cooling air outlet and (ii) the process air inlet forms the cooling air inlet.

5. The surface cleaning machine in accordance with claim 3, wherein the cooling air inlet, the process air inlet and a common outlet for cooling air and process air are provided.

6. The surface cleaning machine in accordance with claim 3, wherein the cooling air inlet is arranged at the cleaning head or at a transition region from the cleaning head to the housing of the device body.

7. The surface cleaning machine in accordance with claim 3, wherein the process air inlet is formed by one or more suction mouths at the cleaning head.

8. The surface cleaning machine in accordance with claim 7, wherein the cooling air inlet is arranged at a distance from the process air inlet.

9. The surface cleaning machine in accordance with claim 3, wherein the process air outlet is arranged at the device body.

10. The surface cleaning machine in accordance with claim 1, wherein the drive motor is arranged in a motor housing.

11. The surface cleaning machine in accordance with claim 10, wherein the cooling air routing device comprises at least one fluid path through the motor housing.

12. The surface cleaning machine in accordance with claim 10, wherein the motor housing is arranged in a sleeve.

13. The surface cleaning machine in accordance with claim 12, wherein the cooling air routing device comprises at least one fluid path which at least one of (i) is located along the sleeve and (ii) is located between the sleeve and the, or a, motor housing.

14. The surface cleaning machine in accordance with claim 13, wherein the cooling air routing device comprises a first fluid path which extends along the sleeve and is located at an exterior side of the sleeve, and comprises a second fluid path which extends along the sleeve at an interior side of the sleeve facing towards the motor housing.

15. The surface cleaning machine in accordance with claim 10, wherein the motor housing extends along an axial direction between a first end and a second end and wherein a cooling air inlet of the cooling air routing device is positioned at the surface cleaning machine, between the first end and the second end relative to the axial direction.

16. The surface cleaning machine in accordance with claim 1, wherein the cleaning head is pivotable relative to the drive motor, and wherein a pivot axis of the cleaning head lies transversely with respect to an axis of rotation of the at least one cleaning roller.

17. The surface cleaning machine in accordance with claim 16, wherein the sleeve is connected to the device body in rotationally fixed relation therewith.

18. The surface cleaning machine in accordance with claim 1, wherein the cooling air routing device is coupled to a suction area of the process air routing device.

19. The surface cleaning machine in accordance with claim 18, wherein at least one fluid path of the cooling air routing device opens out into at least one suction path of the process air routing device.

20. The surface cleaning machine in accordance with claim 19, wherein the at least one fluid path comprises at least one rib which is associated with a mouth of the at least one fluid path of the cooling air routing device into the at least one suction path.

21. The surface cleaning machine in accordance with claim 19, wherein a blocking element for blocking the ingress of droplets from the at least one suction path into the cooling air routing device is arranged at a mouth of the cooling air routing device into the at least one suction path.

22. The surface cleaning machine in accordance with claim 21, wherein the blocking element comprises an area with which it projects into the at least one suction path.

23. The surface cleaning machine in accordance with claim 19, wherein the at least one suction path has opening thereinto at least one drain channel for liquid.

24. The surface cleaning machine in accordance with claim 19, wherein the at least one fluid path of the cooling air routing device which opens into at least one suction path of the process air routing device is arranged downstream of the drive motor with respect to a cooling air flow.

25. The surface cleaning machine in accordance with claim 19, wherein the at least one suction path of the process air routing device into which the at least one fluid path of the cooling air routing device opens is located upstream of the fan.

26. The surface cleaning machine in accordance with claim 1, wherein the suction unit device comprises a fan motor for the fan which is arranged in the housing.

27. The surface cleaning machine in accordance with claim 1, wherein the drive motor is positioned at the cleaning head or is positioned at a transition region from the cleaning head to the housing.

28. The surface cleaning machine in accordance with claim 1, wherein a drive axis of the drive motor and a rotary axis of the at least one cleaning roller are oriented transversely.

29. The surface cleaning machine in accordance with claim 1, wherein a gear device is provided for transmitting torque from the drive motor to the at least one cleaning roller.

30. The surface cleaning machine in accordance with claim 1, wherein the cleaning head is located at the device body via a joint for pivotal movement about a pivot axis.

31. The surface cleaning machine in accordance with claim 30, wherein at least one of (i) the pivot axis is oriented transversely with respect to a longitudinal axis of the device body and (ii) a drive axis of the drive motor is at least approximately parallel to or coaxial with the pivot axis.

32. The surface cleaning machine in accordance with claim 1, wherein at least one of (i) a tank device for the cleaning liquid is arranged at the device body and (ii) a receiving device for dirt is arranged at the device body and (iii) a tank device for dirty liquid is arranged at the device body.

33. The surface cleaning machine in accordance with claim 1, wherein, when operated in a cleaning mode, the surface cleaning machine is only supported via the at least one cleaning roller on a surface to be cleaned.

34. The surface cleaning machine in accordance with claim 1, wherein at least one of an inlet for air and an outlet for air comprises one or more slits or is formed by one or more slits.

35. A surface cleaning machine, comprising:

a device body having a housing;

a suction unit device having a fan, said suction unit device being arranged in the housing;

a cleaning head which is arranged at the device body outside of the housing and comprises at least one cleaning roller and is operatively connected to the suction unit device for fluid communication therewith;

an air-cooled drive motor for rotatingly driving the at least one cleaning roller; and a process air routing device for process air of the suction unit device;

wherein the drive motor is arranged outside of the housing of the device body and wherein at least one of (i) a cooling air routing device for cooling air of the drive motor comprises at least one fluid path which is arranged at or in the housing and (ii) the cooling air routing device is coupled to the process air routing device, and wherein at least one of (i) a tank device for cleaning liquid is arranged at the device body and (ii) a receiving device for dirt is arranged at the device body and (iii) a tank device for dirty liquid is arranged at the device body.

36. A surface cleaning machine, comprising:

a device body having a housing;

a suction unit device having a fan, said suction unit device being arranged in the housing;

a cleaning head which is arranged at the device body outside of the housing and comprises at least one cleaning roller and is operatively connected to the suction unit device for fluid communication therewith;

an air-cooled drive motor for rotatingly driving the at least one cleaning roller; and a process air routing device for process air of the suction unit device;

wherein the drive motor is arranged outside of the housing of the device body and wherein at least one of (i) a cooling air routing device for cooling air of the drive motor comprises at least one fluid path which is arranged at or in the housing and (ii) the cooling air routing device is coupled to the process air routing device, and wherein, when operated in a cleaning mode, the surface cleaning machine is only supported via the at least one cleaning roller on a surface to be cleaned.

37. A surface cleaning machine, comprising:

a device body having a housing;

a suction unit device having a fan, said suction unit device being arranged in the housing;

a cleaning head which is arranged at the device body outside of the housing and comprises at least one cleaning roller and is operatively connected to the suction unit device for fluid communication therewith;

an air-cooled drive motor for rotatingly driving the at least one cleaning roller; and a process air routing device for process air of the suction unit device;

wherein the drive motor is arranged outside of the housing of the device body and wherein at least one of (i) a cooling air routing device for cooling air of the drive motor comprises at least one fluid path which is arranged at or in the housing and (ii) the cooling air routing device is coupled to the process air routing device, wherein the cooling air routing device comprises a cooling air inlet and a cooling air outlet and wherein the process air routing device comprises a process air inlet and a process air outlet and wherein at least one of (i) the cooling air inlet and the process air inlet coincide and (ii) the cooling air outlet and the process air outlet coincide, and wherein at least one of (i) the process air outlet forms the cooling air outlet and (ii) the process air inlet forms the cooling air inlet.

38. A surface cleaning machine, comprising:

a device body having a housing;

a suction unit device having a fan, said suction unit device being arranged in the housing;

a cleaning head which is arranged at the device body outside of the housing and comprises at least one cleaning roller and is operatively connected to the suction unit device for fluid communication therewith;

an air-cooled drive motor for rotatingly driving the at least one cleaning roller; and a process air routing device for process air of the suction unit device;

wherein the drive motor is arranged outside of the housing of the device body and wherein at least one of (i) a cooling air routing device for cooling air of the drive motor comprises at least one fluid path which is arranged at or in the housing and (ii) the cooling air routing device is coupled to the process air routing device, wherein the drive motor is arranged in a motor housing, and wherein the motor housing is arranged in a sleeve.

39. A surface cleaning machine, comprising:

a device body having a housing;

a suction unit device having a fan, said suction unit device being arranged in the housing;

a cleaning head which is arranged at the device body outside of the housing and comprises at least one cleaning roller and is operatively connected to the suction unit device for fluid communication therewith;

an air-cooled drive motor for rotatingly driving the at least one cleaning roller; and a process air routing device for process air of the suction unit device;

wherein the drive motor is arranged outside of the housing of the device body and wherein at least one of (i) a cooling air routing device for cooling air of the drive motor comprises at least one fluid path which is arranged at or in the housing and (ii) the cooling air routing device is coupled to the process air routing device, wherein the cooling air routing device is coupled to a suction area of the process air routing device, wherein at least one fluid path of the cooling air routing device opens out into at least one suction path of the process air routing device, and wherein a blocking element for blocking the ingress of droplets from the at least one suction path into the cooling air routing device is arranged at a mouth of the cooling air routing device into the at least one suction path.

40. A surface cleaning machine, comprising:

a device body having a housing;

a suction unit device having a fan, said suction unit device being arranged in the housing;

a cleaning head which is arranged at the device body outside of the housing and comprises at least one cleaning roller and is operatively connected to the suction unit device for fluid communication therewith;

an air-cooled drive motor for rotatingly driving the at least one cleaning roller; and a process air routing device for process air of the suction unit device;

wherein the drive motor is arranged outside of the housing of the device body and wherein at least one of (i) a cooling air routing device for cooling air of the drive motor comprises at least one fluid path which is arranged at or in the housing and (ii) the cooling air routing device is coupled to the process air routing device, and wherein a drive axis of the drive motor and a rotary axis of the at least one cleaning roller are oriented transversely.

* * * * *